US006820928B1

(12) United States Patent
Ransom

(10) Patent No.: US 6,820,928 B1
(45) Date of Patent: Nov. 23, 2004

(54) LOW-PROFILE SEAT WITH RELOCATABLE BACKREST

(76) Inventor: Robert M. Ransom, 8102 Coldwater Rd., Flushing, MI (US) 48433

( * ) Notice: Subject to any disclaimer, the term of this patent is extended or adjusted under 35 U.S.C. 154(b) by 0 days.

(21) Appl. No.: 10/446,315

(22) Filed: May 29, 2003

(51) Int. Cl.[7] ..... A47C 4/00

(52) U.S. Cl. ..... 297/29; 297/51; 297/53; 297/283.3; 297/353; 297/463.1

(58) Field of Search ..... 297/29, 51, 53, 297/54, 92, 283.3, 353, 452.2, 463.1, 463.2, 94, 100, 101, 16.1, 19, 22, 283.1

(56) References Cited

U.S. PATENT DOCUMENTS

| | | | | | |
|---|---|---|---|---|---|
| 728,209 | A | * | 5/1903 | Dawson et al. | 160/88 |
| 984,939 | A | * | 2/1911 | Krile | 297/45 |
| 2,450,783 | A | * | 10/1948 | Collins | 297/397 |
| 3,589,661 | A | | 6/1971 | Harris | |
| 4,772,068 | A | * | 9/1988 | Gleckler et al. | 297/39 |
| 5,246,265 | A | * | 9/1993 | Nagan et al. | 297/54 |
| D343,525 | S | | 1/1994 | Wright | |
| 6,012,769 | A | * | 1/2000 | Hsueh et al. | 297/19 |
| 6,015,190 | A | * | 1/2000 | Wend | 297/378.1 |
| D440,058 | S | | 4/2001 | Owens et al. | |
| D454,437 | S | * | 3/2002 | Minneman et al. | D6/349 |

FOREIGN PATENT DOCUMENTS

| | | | | |
|---|---|---|---|---|
| DE | 3402846 | * | 8/1985 | |
| GB | 2244211 A | * | 11/1991 | A47C/1/00 |

* cited by examiner

*Primary Examiner*—Laurie K. Cranmer
(74) *Attorney, Agent, or Firm*—Young & Basile, P.C.

(57) ABSTRACT

The invention is a foldable chair for use by hunters and outdoorsmen. The chair is equipped with folding leg elements positioned at opposite ends of a frame-mounted seating surface. The leg assemblies have different heights, allowing the chair to be positioned on uneven terrain. Additionally, the chair is provided with a relocatable backrest, which may be pivoted from one side of the seating surface to the other. A carrying strap is provided for facilitating carrying of the chair.

6 Claims, 3 Drawing Sheets

LOW-PROFILE SEAT WITH RELOCATABLE BACKREST

FIELD OF THE INVENTION

The invention pertains to portable chairs for outdoorsmen, and more particularly, to such chairs which are collapsible and reconfigurable to accommodate the variations in terrain.

BACKGROUND OF THE INVENTION

Hunting remains a popular sport throughout the world. Recreational hunters own and maintain a wide spectrum of hunting equipment, specialized for use in hunting particular game, during particular seasons and in particular terrain.

Popular among hunters of wild birds (such as turkeys) are low-profile seats. It is known that seating positions close to the ground provide advantages for such hunters, and as a result, a number of portable chairs have been developed for those engaged in hunting of wild birds. Because the sport requires substantial patience and finds the hunter located in unimproved, remote wilderness areas, it can be difficult to find and occupy a suitable position for hunting unless the hunter is equipped with a comfortable, portable and lightweight chair.

A number of devices have been developed for this specific purpose. A typical hunter's stool is disclosed in U.S. Pat. No. 3,589,661, issued to Harris. This device is designed in the form of conventional folding director's chair.

Another effort at providing a lightweight, foldable and comfortable low-profile chair is disclosed by Wright, in U.S. Pat. No. Des. 343525. Rigid plastic chairs for hunting purposes have also been developed by Wend, as shown in U.S. Pat. No. 6,015,190 and Minneman, et al., in U.S. Pat. No. Des. 454,437S.

A significant problem in existing designs is their limited adaptability to variations in slope of the terrain in which the hunter sits. Rarely is the ground selected for the hunter's position level, and chairs having backs may be difficult to conform to the variations in the terrain with which the hunter is presented. At the same time, it is desirable for the chair to be located off the surface of the ground, since chairs such as those taught by Wright tend to absorb dirt and moisture, and transmit the cold temperatures of the ground through to the hunter's body. Additionally, current low-profile designs tend to be bulky, even when folded, a disadvantage when considering the amount of material which must be carried to the hunting site by the hunter.

There exists, therefore, a need for an improved portable hunting chair which has features desirable to hunters, particularly the ability to adapt the position of the chair to variations in slope while still providing to the hunter a relatively flat surface on which to rest while awaiting his prey.

SUMMARY OF THE INVENTION

The present invention addresses the foregoing, and other needs, by providing a foldable chair, complete with a seat back that folds against the seat bottom when being carried so as to provide a low profile, lightweight and portable package.

In use, the seat has multiple configurations which, including one for stowage of the seat back, as well as re-positioning the seat back in relationship to the seat base. By providing the seat base with leg members of different heights, the seat can be easily positioned on sloped terrain and still provide to the hunter a substantially horizontal seating surface.

Consistent with these aspects of the invention, a foldable chair is provided with a seat base assembly having a seat bottom frame covered with a fabric seat bottom, a seat back which is provided with an upper rest and a lumbar support, and a pair of pivoting support arms which allow the seat back assembly to be easily repositioned from one side of the seat base assembly to the other. The legs which support the seat base assembly are higher at one end of the seat base assembly than they are at the other, allowing the seat base assembly to be oriented in a more or less horizontal position regardless of the slope on which the seat is placed. Because the seat back assembly is articulating, it can be repositioned from one side of the seat base assembly to the other, thereby insuring that the user has a back support regardless of the orientation of the seat base assembly.

By providing the seat base assembly and back assembly with appropriate pivot points, the entire seat can be folded flat for transport or used as a seat with the back folded. Further, by providing shoulder straps integral with the seat bottom frame, the folded assembly can be easily transported in a knapsack-like fashion by the hunter, or strapped to other items of the hunter's equipment.

The chair has additional features, including camouflage coloring to render the chair less visible in the hunting environment.

These and other advantages and features of the invention are described in detail in the description and claims annexed hereto and forming a further part hereof. A full understanding of the invention, and the advantages and objectives obtained through its design and use will be apparent from a study of the attached drawings and the following detailed description.

PREFERRED DESCRIPTION OF THE PREFERRED EMBODIMENT

Figure 1:
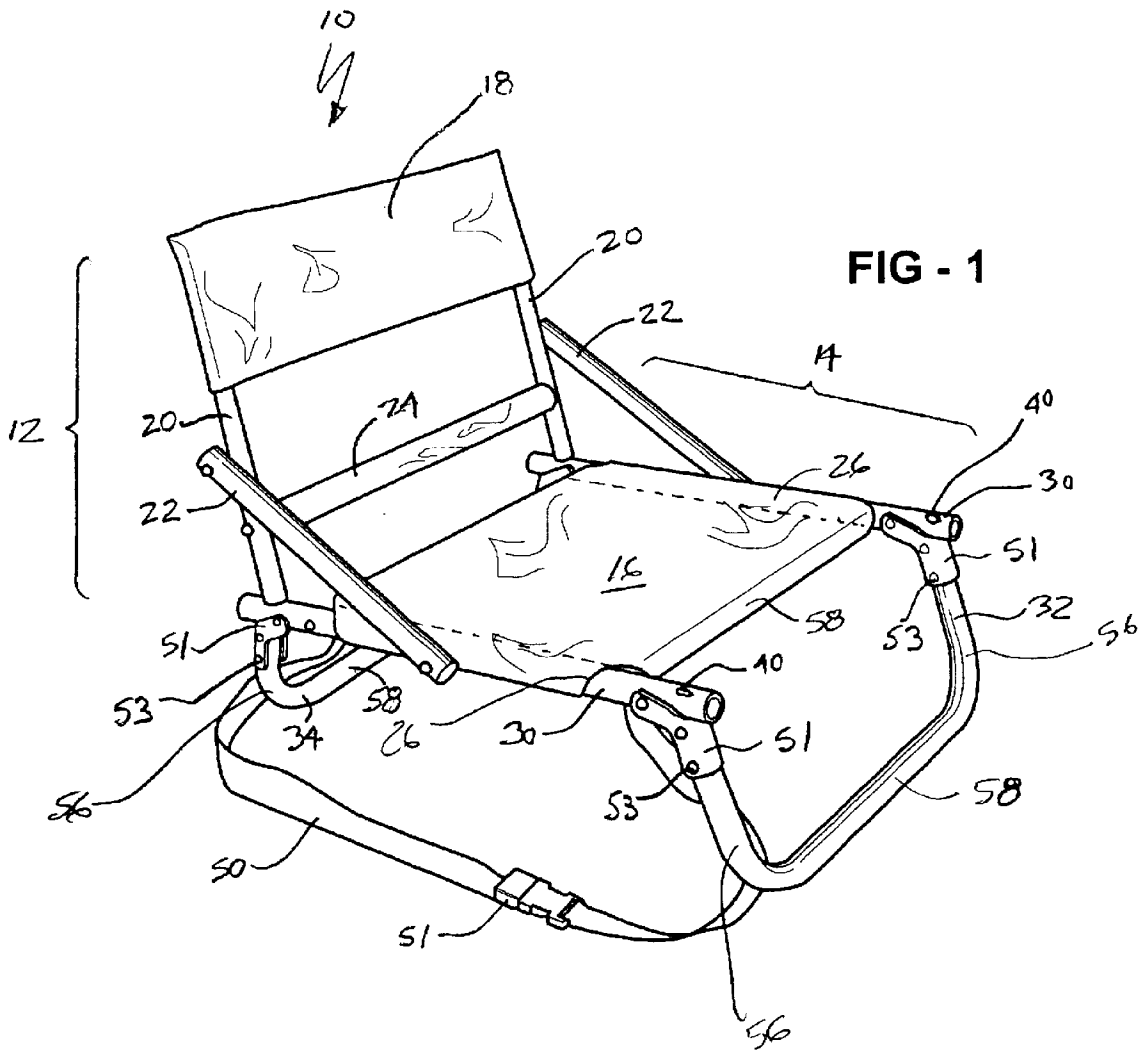
FIG. 1 is a front perspective view of the described embodiment consistent with the invention in its unfolded condition.
Figure 2:
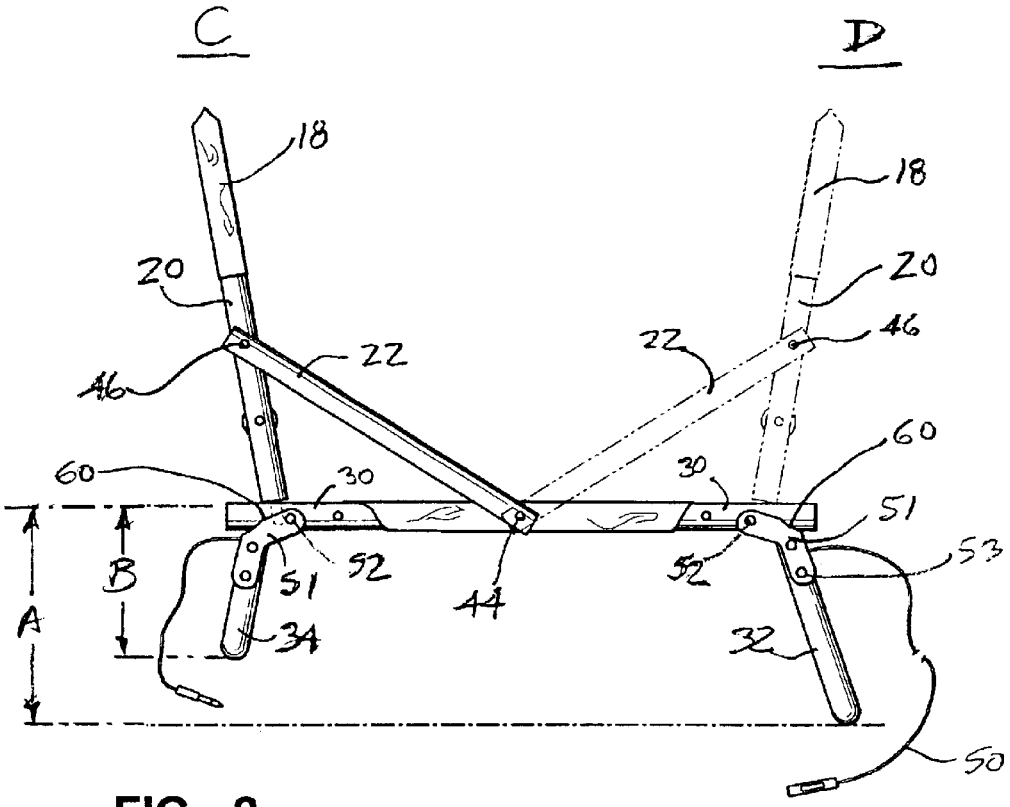
FIG. 2 is a side view of the invention, showing the seat back in its two alternative positions when the chair is in use.
Figure 3:
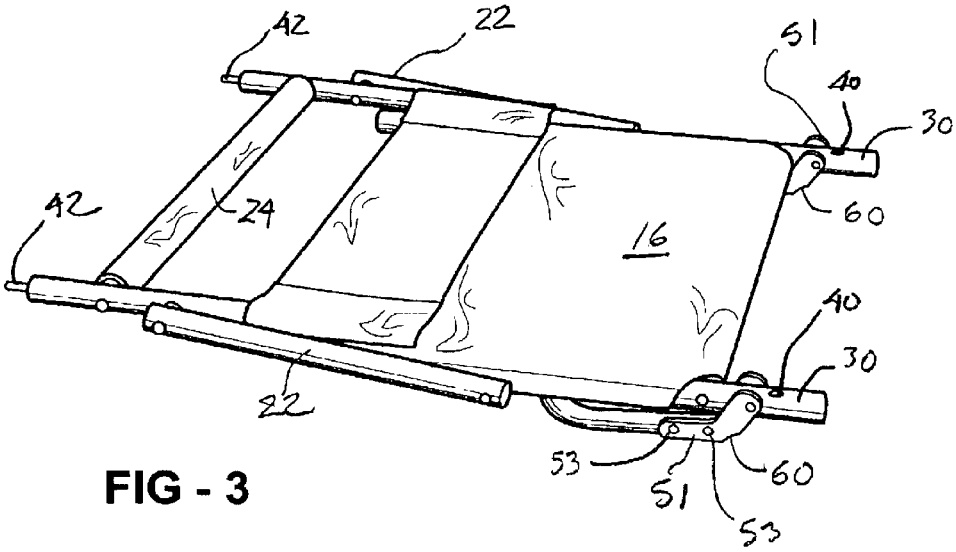
FIG. 3 is a perspective view of the invention in its folded configuration.

The following embodiment will best be understood by reference to FIGS. 1-3. The low-profile seat 10 with a relocatable backrest includes two major sub-assemblies, the base assembly 14 and the back assembly 12.

The base assembly 14, on which the user sits, is provided with a lightweight, flexible seating surface 16, typically fabricated from Dacron, cotton or other woven fabric. The base assembly frame is comprised of two seat frame sides 30 and two seat frame cross-members 58 which form a roughly rectangular framework on which seating surface 16 is attached. Seating surface 16 may be attached to seat frame sides 30 and cross-members 58 by fasteners, adhesives and the like, or may be provided with sleeves 26 through which pass the seat frame sides 30 and cross-members 58. Cross-members 58 are affixed to seat frame sides 30 by well known means, which may include fasteners. Likewise, cross-members 58 may be inserted into openings (not shown) in seat frame sides 30, and held in position by the tension provided by seating surface 16 when it is secured to frame sides 30. Each end of seat frame sides 30 are provided with sockets 40 designed to accommodate the back assembly 12 in a manner to be described herein.

Pivotably attached to the seat frame sides 30 proximate the ends of sides 30 are a first leg assembly 32 and a second leg assembly 34 which serve to elevate the seat frame sides 30, cross-members 58 and seating surface 16 from the ground when the seat 10 is in use.

Back assembly 12 comprises an upper backrest 18, a lumbar support 24, a pair of opposed uprights 20 and a pair of diagonal supports 22. Upper backrest 18 is, in one embodiment, manufactured from fabric material similar to the material used for seating surface 16 and affixed to uprights 20. Additionally, lumbar support 24 is affixed to uprights 20 and is provided with a pad and is likewise covered with a fabric material comparable to the fabric material of upper backrest 18 and seating surface 16. In one embodiment, the fabric material so provided is pre-printed with a camouflage pattern or other patterns designed to make the entire assembly blend easily into the background environment. Alternatively, the fabric may be of high contrast material, such as hunter's orange in hunting situations where high visibility may be desirable.

To facilitate carrying the seat 10 to and from the hunting site, the seat is provided with a pair of shoulder straps 50 fitted with adjusters 51 so that the seat 10 may be carried in the manner of a knapsack or strapped to other equipment being carried by the hunter.

The reconfiguration of the seat is best understood by reference to FIG. 2 and FIG. 3. Diagonal supports 22 are pivotably connected at the center point of each seat frame side 30 at diagonal lower pivot point 44. The opposite end of diagonal support 22 is pivotably connected to each upright 20 at the diagonal upper pivot point 46. Each upright 20 is further provided with a pin 42, adapted to be engageable with socket 40 located in each seat side frame 30. In this fashion, the back assembly 12 may be repositioned from one end of the base assembly 14 to the other, by lifting the back assembly 12 to disengage pins 42 from sockets 40 on one end of the seat frame sides 30, and rotating the back assembly 12 from position C to position D as shown in FIG. 2, and re-engaging the pins 42 at the bottom of uprights 20 into sockets 40 at the opposite end of seat frame sides 30.

Also shown in FIG. 2, second leg assembly 34 and first leg assembly 32 are of different heights, as depicted by the dimensions "A" and "B". Each leg assembly 32 and 34 comprises a pair of legs 56 interconnected by cross-members 58. Leg assemblies 32 and 34 are mounted to the seat frame sides 30 at leg pivots 52 to allow leg assemblies 32 and 34 to be folded flat against the base assembly 14. Leg assemblies 32 and 34 are further provided brackets 51 with stops 60 which engage, by interference fit, the outer surface of seat frame sides 30, thereby holding the leg assemblies 32 and 34 in the extended position as shown in FIG. 2 when the seat 10 is in use. Brackets 51 are secured to leg assemblies 32 and 34 by fasteners 53, such as rivets. Since leg assembly 34 is of a different height than leg assembly 32, it can be appreciated that it will be possible to place the seat 10 on a sloping site, and to position back assembly 12 in the appropriate relationship to the base assembly 14 to provide the hunter with a substantially horizontal seating surface 16, and a relatively comfortable backrest 18 and lumbar support 24, in relation to the overall slope of the ground.

Figure 4:
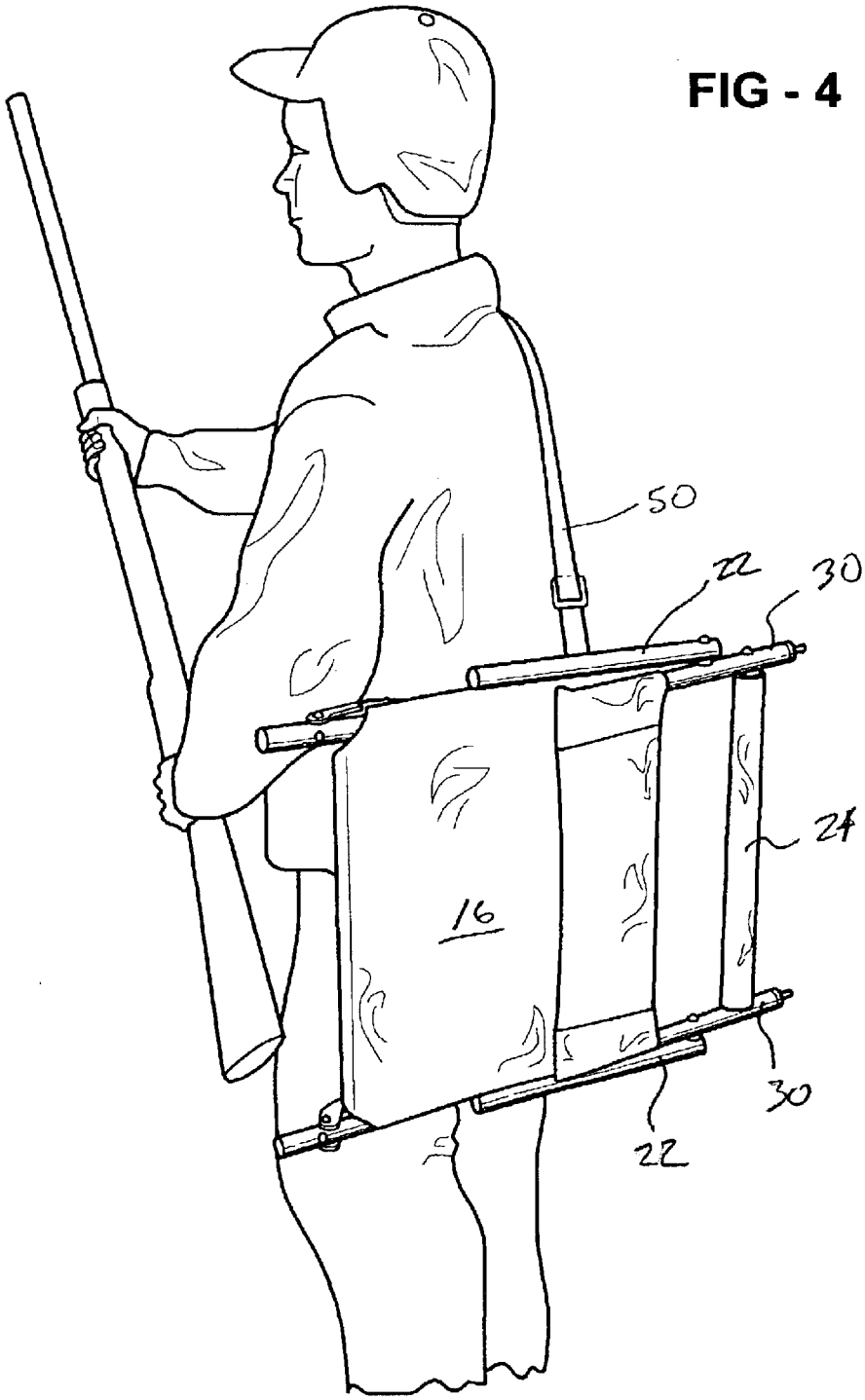
FIG. 4 is a perspective view of the invention as transported by the user.

As can be seen in FIG. 3, the assembly is readily collapsible to a substantially flat package for transport. By rotating back assembly 12 parallel to the seating surface 16, and lowering the diagonal supports 22 to position nearly parallel to seat frame sides 30, the back assembly 12 and base assembly 14 are brought into contact. Thereafter, leg assembly 34 and leg assembly 32 may be pivoted inward and upward toward the underside of seating surface 16, thereby reducing the overall thickness of the folded package. Shoulder straps 50 permit the completed package to be conveniently carried by the user as shown in FIG. 4.

What is claimed is:

1. A foldable chair, comprising:

a base assembly further comprising a first frame and a seating surface supported by said first frame;

a backrest assembly further comprising a second frame and a back support surface supported by said second frame;

a pair of pivoting diagonal supports connected to said base assembly and said backrest assembly, whereby said backrest assembly may be selectively positioned to have a first and second seating direction wherein said first seating direction is substantially opposite to said second seating direction;

a first leg assembly attached to said first frame comprising a pair of legs having a first dimension;

a second leg assembly attached to said first frame having a second pair of legs having a second dimension, which second dimension is different from said first dimension.

2. The invention of claim 1, wherein said first leg assembly and said second leg assembly are pivotally attached to said first frame.

3. The invention of claim 2, wherein said backrest assembly further comprises a separate lumbar support affixed to said second frame.

4. The invention of claim 1, wherein said backrest assembly further comprises a separate lumbar support affixed to said second frame.

5. The invention of claim 1, wherein said first pair of legs are interconnected and wherein said second pair of legs are interconnected.

6. The invention of claim 1, wherein said chair further comprises a carrying strap.

* * * * *